US005628064A

United States Patent [19]

Chung

[11] Patent Number: 5,628,064

[45] Date of Patent: May 13, 1997

[54] SEPARTABLE CLOTHES INCLUDING SHIRTS

[76] Inventor: Chin-Fu Chung, No. 898, Min-Sheng St., Kuei-Jen Hsiang, Tainan Hsien, Taiwan

[21] Appl. No.: 532,151

[22] Filed: Sep. 22, 1995

[51] Int. Cl.[6] ..... A41B 1/08

[52] U.S. Cl. ..... 2/70; 2/77; 2/126; 2/119; 2/93; 2/79

[58] Field of Search ..... 2/71, 70, 72, 86, 2/93, 95, 115, 116, 124, 126, 212, 213, 227, 77, 119, 79, 74

[56] References Cited

U.S. PATENT DOCUMENTS

| | | | |
|---|---|---|---|
| 2,513,065 | 6/1950 | Stagg | 2/70 |
| 2,515,082 | 7/1950 | Evans | 2/70 |
| 2,598,759 | 6/1952 | Calde | 2/70 |
| 2,705,805 | 4/1955 | Weinberg | 2/70 |
| 4,390,996 | 7/1983 | Read | 2/86 |
| 4,554,682 | 11/1985 | Hillquist | 2/70 |
| 4,999,850 | 3/1991 | Grilliot et al. | 2/70 |

*Primary Examiner*—C. D. Crowder
*Assistant Examiner*—Larry O. Worrell, Jr.
*Attorney, Agent, or Firm*—Varndell Legal Group

[57] ABSTRACT

Separatable clothes including a base panel for covering a part of the body, and a plurality of auxiliary panels detachably fastening to one another or to the base panel by zippers, hook and loop materials, and snaps for covering the limbs or a part of the body.

2 Claims, 9 Drawing Sheets

SEPARTABLE CLOTHES INCLUDING SHIRTS

BACKGROUND OF THE INVENTION

The present invention relates to clothes, and relates more particularly to separatable clothes which can be alternatively arranged into any of a variety of forms.

Clothes designers design different colors and styles of clothes every year to create fashions. Furthermore, regular clothes are not suitable for wearing in all seasons. For example, a clothes for the winter season is not suitable for wearing in the summer season.

SUMMARY OF THE INVENTION

A separatable clothes according to the present invention comprises a base panel for covering a part of the body, and a plurality of auxiliary panels detachably fastening to one another or to the base panel by zippers, hook and loop materials, and snaps for covering the limbs or a part of the body. The clothes can be a trench coat, a shirt, a pullover, a skirt, a woman's dress, etc., which is comprised of several parts of different, colors that can be alternatively fastened together by the zippers, hook and loop materials, and snaps thereof to show different styles or forms.

DETAILED DESCRIPTION OF THE PREFERRED EMBODIMENTS

Figure 1:
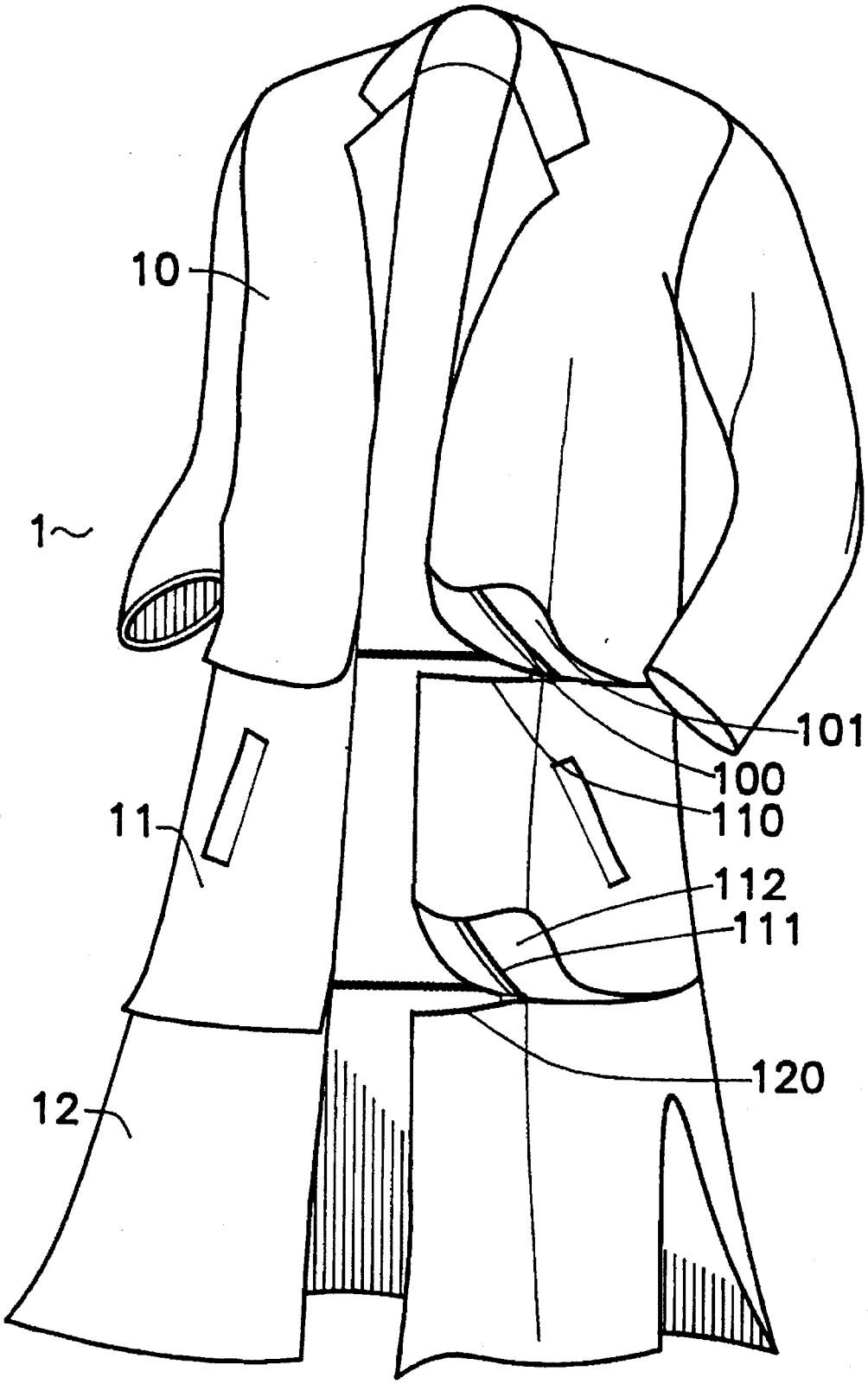
FIG. 1 shows the trench coat made according to the present invention.

Referring to FIG. 1, the trench coat 1 is comprised of a jacket 10, a bottom panel 11, and a hem 12. The jacket 10 and the bottom panel 11 are detachably connected into an overcoat by a zipper 100, which is comprised of two series of tabs 101 and 110 respectively fixed to the jacket 10 and the bottom panel 11. The hem 12 is detachably fastened to the bottom panel 11 by a zipper 112, which is comprised of two series of tabs 111 and 120 respectively fixed to the bottom panel 11 and the hem 12.

Figure 2:
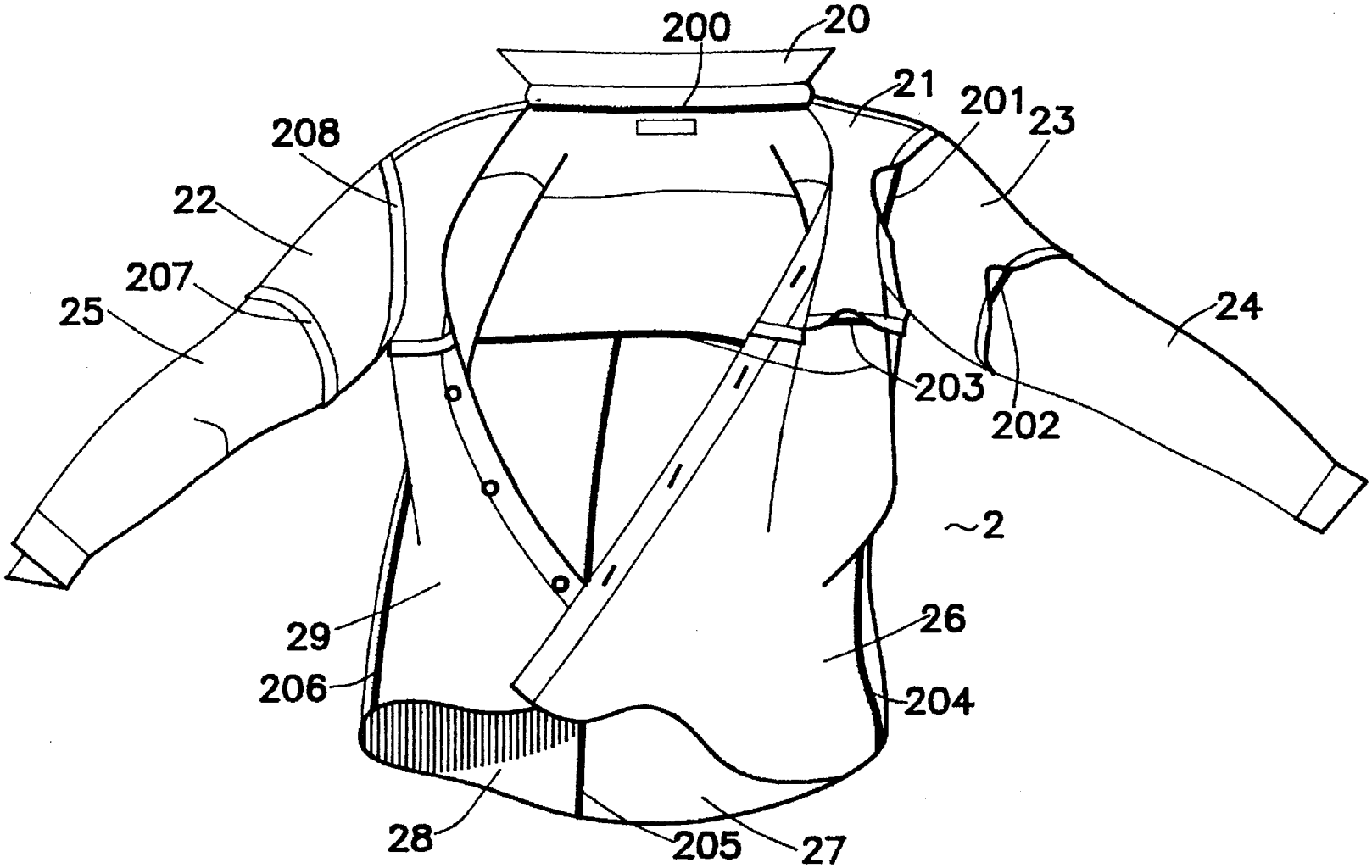
FIG. 2 shows a shirt made according to the present invention.
Figure 3:
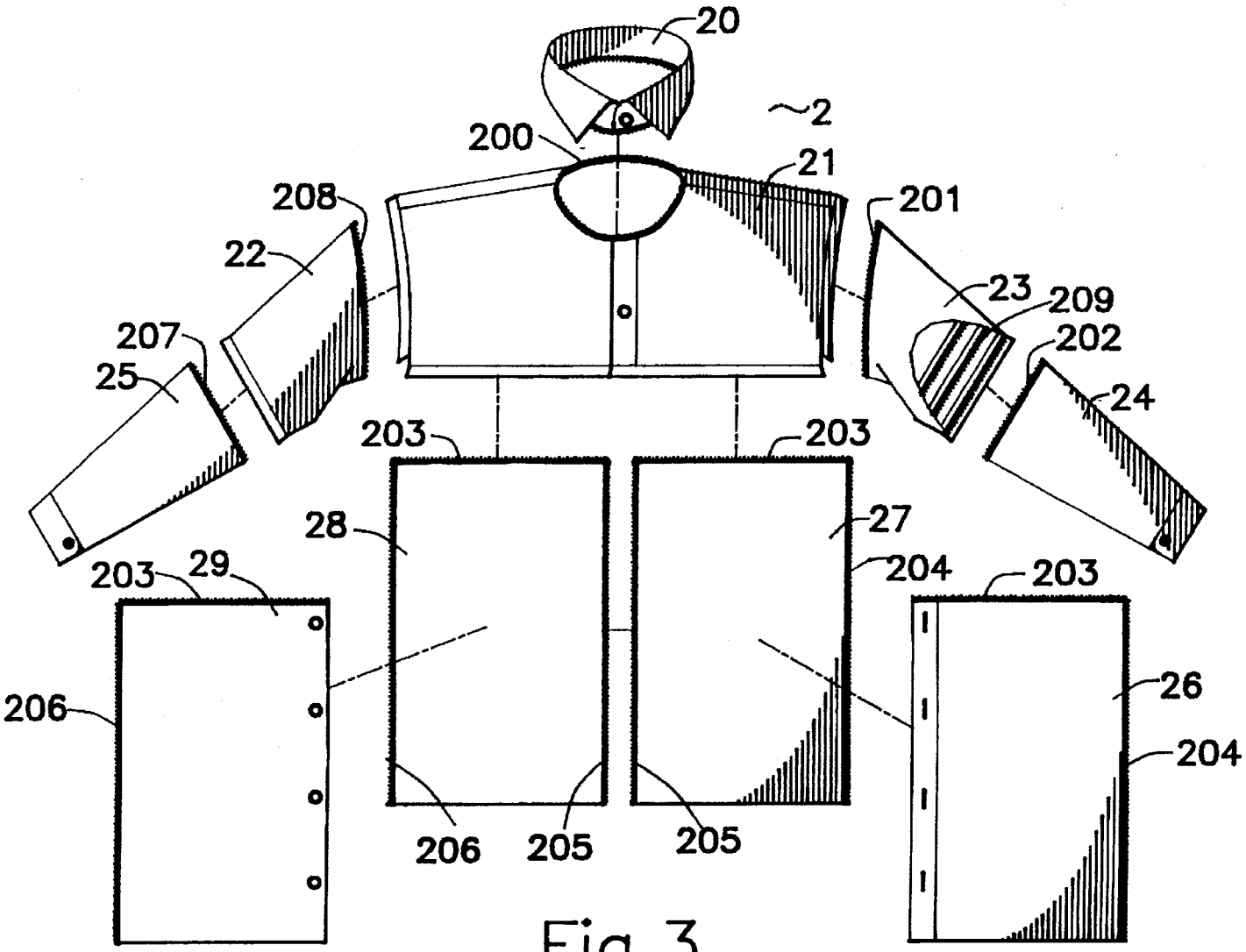
FIG. 3 shows an exploded view of the shirt shown in FIG. 2.

Referring to FIGS. 2 and 3, the shirt 2 is comprised of a shoulder part 21, a collar 20, two upper sleeves 22 and 23, two lower sleeves 24 and 25, a front left panel 26, a front right panel 29, a rear left panel 27, and a rear right panel 28. The collar 20 is fastened to the shoulder part 21 by a zipper 200. The two upper sleeves 22 and 23 are respectively fastened to the shoulder part 21 by zippers 208 and 201, each having three series of tabs 209. The lower sleeves 24 and 25 each has a series of tab 202 or 207 for interlocking with one series of tabs 209 on one upper sleeve 22 or 23. The front left panel 26, the front right panel 29, the rear left panel 27, and the rear right panel 28 are respectively fastened to the shoulder part 21 by a respective zipper 203. The front right panel 29 is fastened to the rear right panel 28 by a zipper 206. The front left panel 26 and the rear left panel 27 are fastened together by a zipper 204. The rear right panel 28 and the rear left panel 27 are fastened together by a zipper 205.

Figure 4:
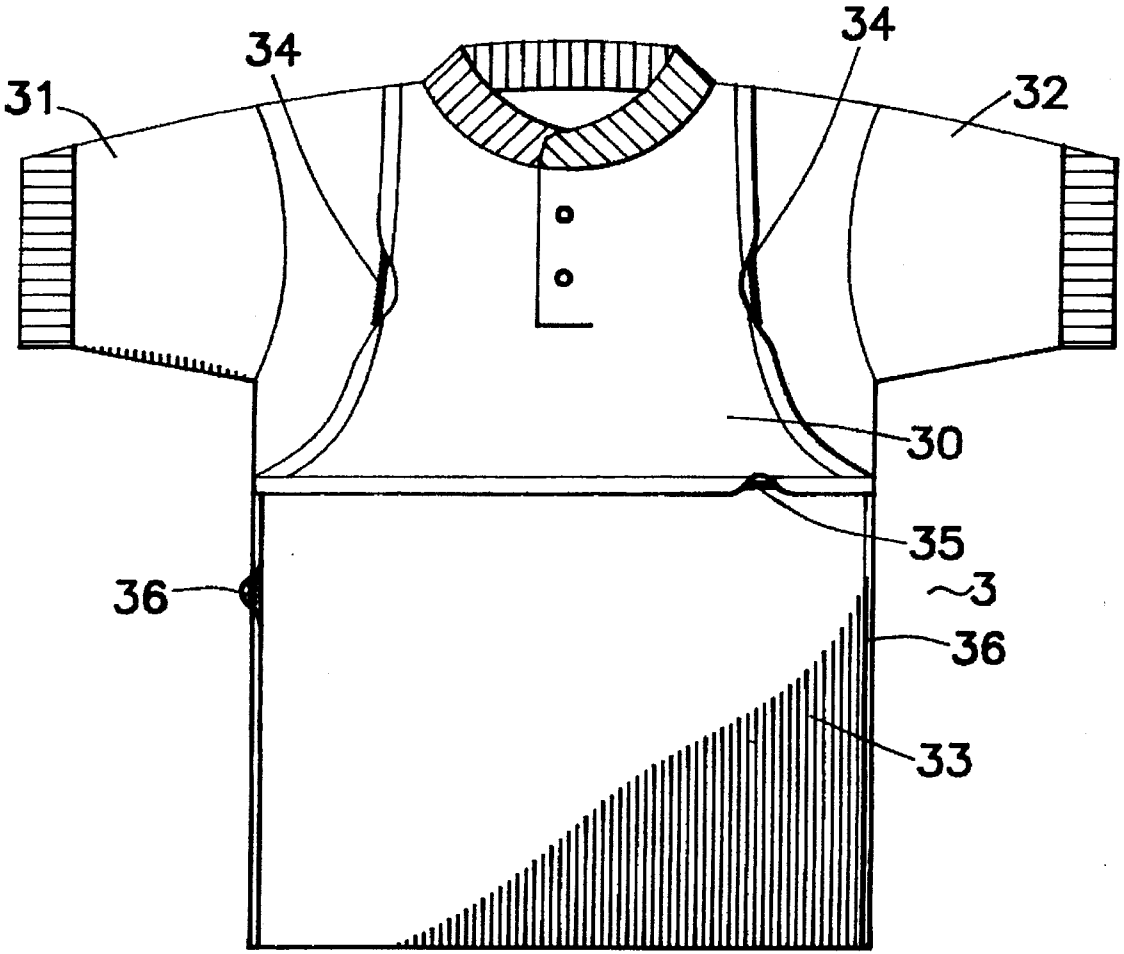
FIG. 4 shows a pullover made according to the present invention.

Referring to FIG. 4, the lower part 33 of the pullover 3 is comprised of a front panel and a rear panel fastened together by two zippers 36; the upper part 30 of the pullover 3 is fastened to the lower part 33 by a zipper 35; the two sleeves 31 and 32 are respectively fastened to the upper part 30 by a respective zipper 34.

Figure 5:
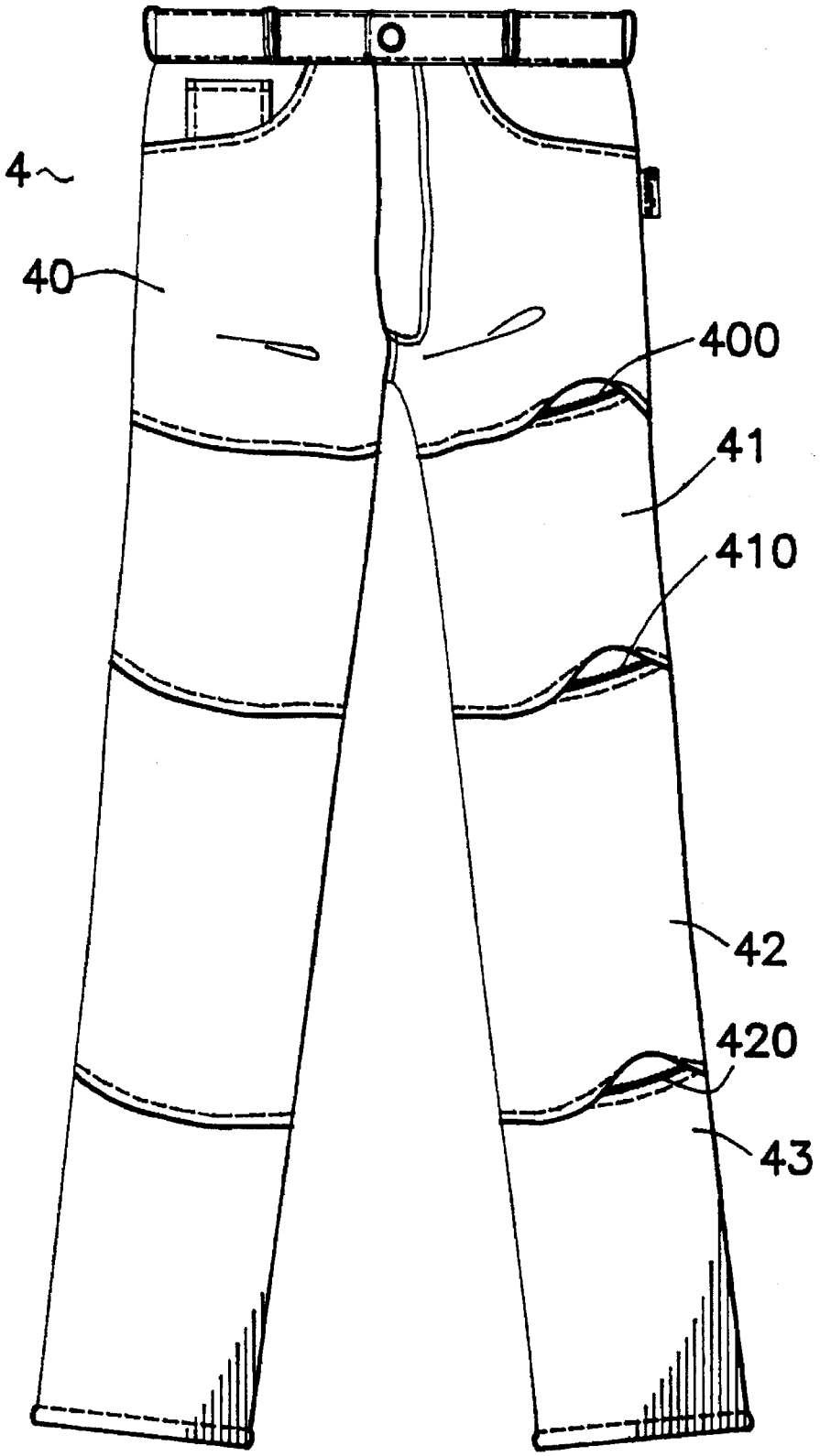
FIG. 5 shows a pair of pants made according to the present invention.
Figure 6:
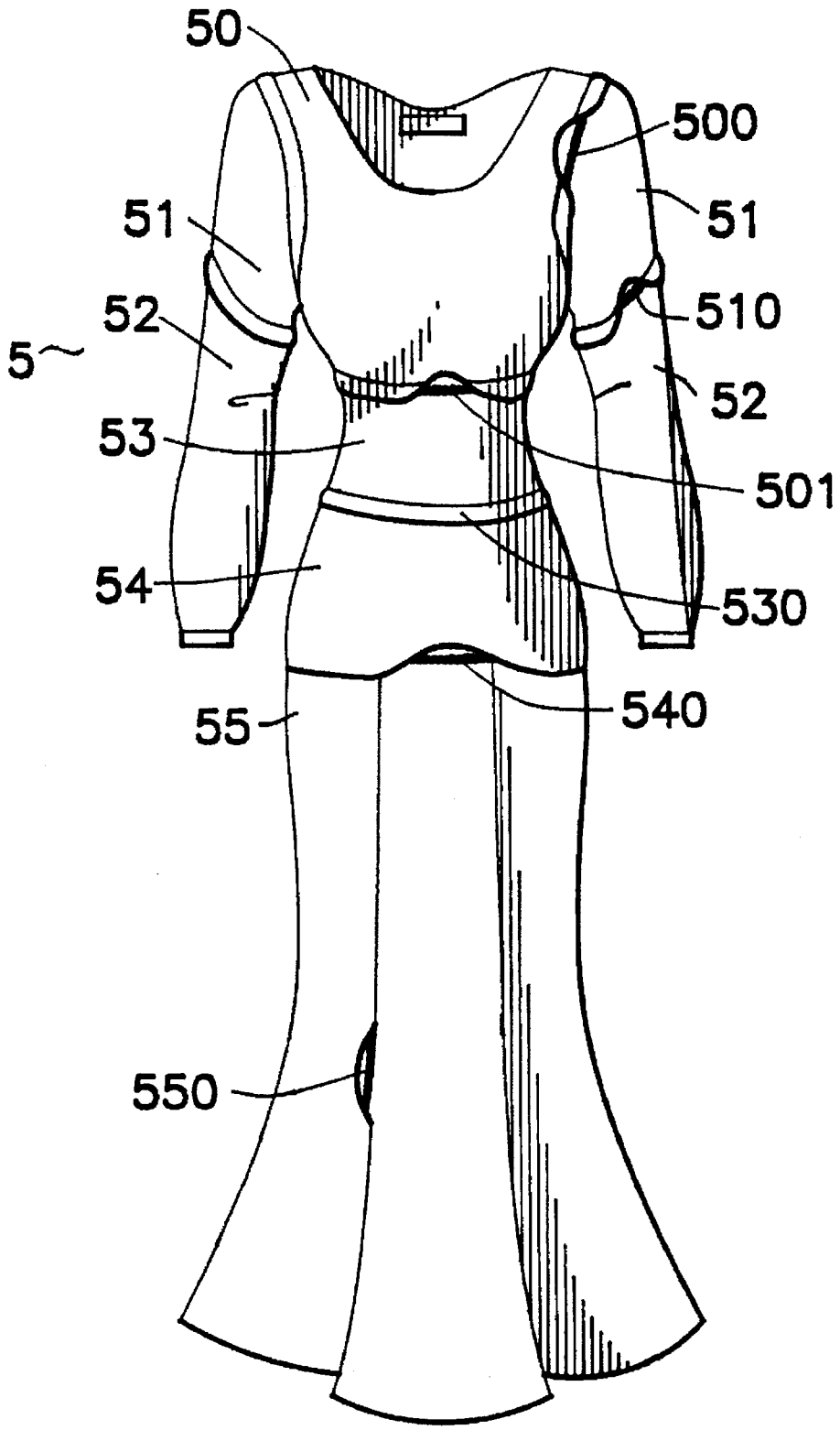
FIG. 6 shows a woman's dress made according to the present invention.

Referring to FIG. 5, the pants 4 is comprised of a shorts 40, a pair of upper coverings for the legs 41 respectively fastened to the shorts 40 by a respective zipper 400, a pair of intermediate coverings for the legs 42 respectively fastened to the upper coverings for the legs 41 by a respective zipper 410, and a pair of bottom coverings for the legs 43 respectively fastened to the intermediate coverings for the legs 42 by a respective zipper 420.

Referring to FIG. 5, the woman's dress 5 comprises a vest 50, two upper sleeves 51 respectively fastened to the vest 50 by a respective zipper, two lower sleeves 52 respectively fastened to the upper sleeves 51 by a respective zipper 510, a girdle 53 fastened to the vest 50 by a zipper 501, an abdominal panel 54 fastened to the girdle 53 by a zipper 530, and a skirt 55 fastened to the abdominal panel 54 by a zipper 540. The skirt 55 is comprised of a panels connected by zippers 550.

Figure 7:
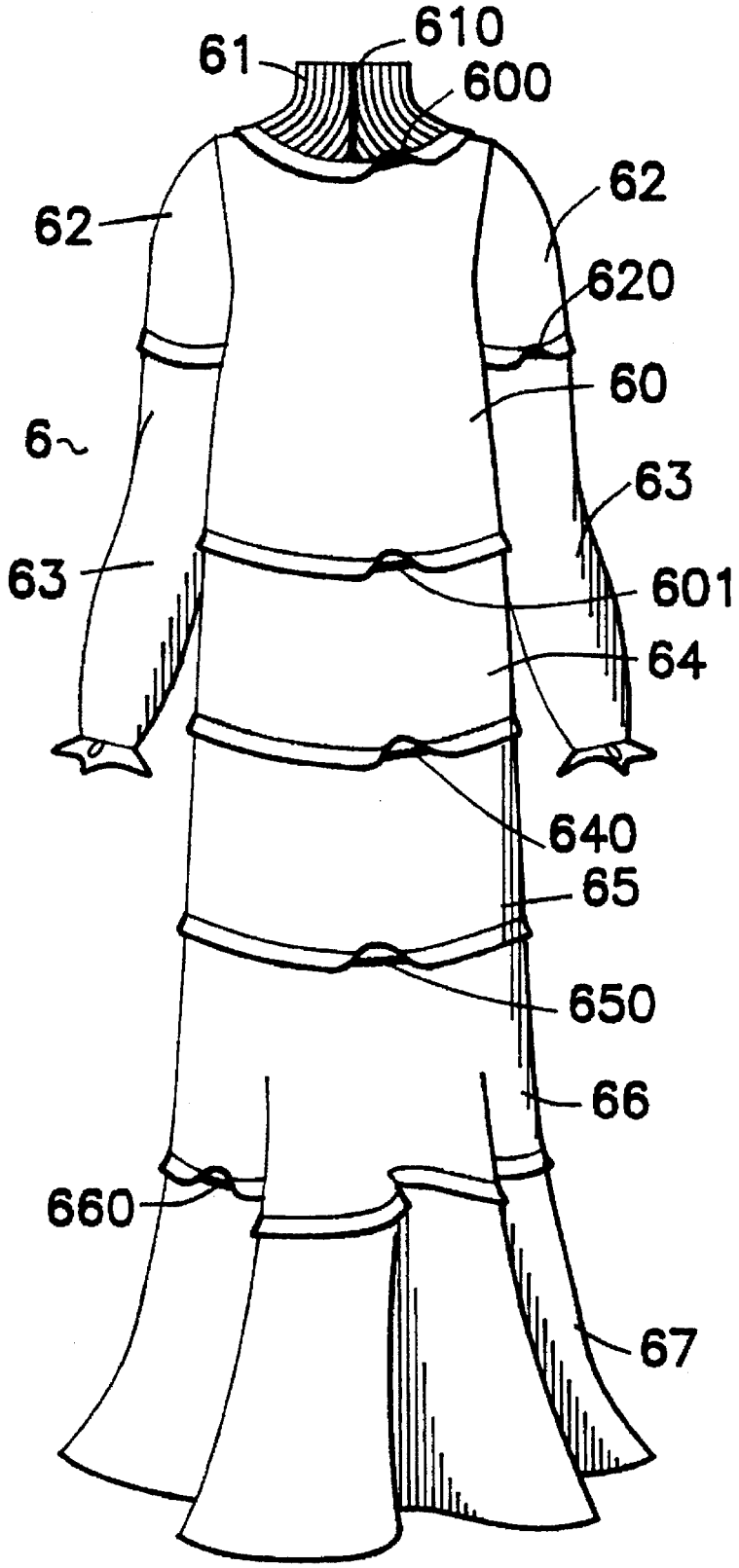
FIG. 7 shows a woman's underwear made according to the present invention.

Referring to FIG. 7, the woman's underwear 6 comprises a collar 61, which consists of two symmetrical parts connected together by a zipper 610, a vest 60 fastened to the collar 61 by a zipper 600 and having two short sleeves 62, two lower sleeves 63 respectively fastened to the upper sleeves 62 by a respective zipper 620, an upper abdominal panel 64 fastened to the vest 60 by a zipper 601, a lower abdominal panel 65 fastened to the upper abdominal panel 64 by a zipper 640, a hip panel 66 fastened to the lower abdominal panel 65 by a zipper 650, and a hem 67 fastened to the hip panel 66 by a zipper 650.

Figure 8:
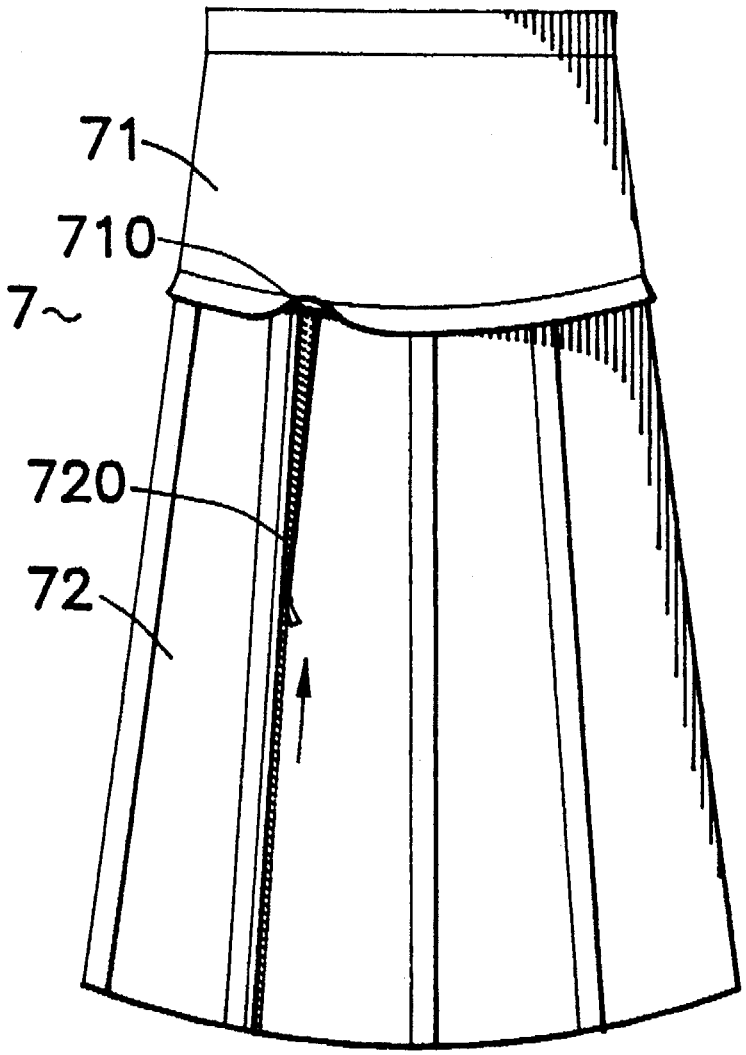
FIG. 8 shows a skirt made according to the present invention.

Referring to FIG. 8, the skirt 7 comprises a waistband and hip panel unit 71, and a pleated skirt body 72 fastened to the waistband and hip panel unit 71 by a zipper 710. The pleated skirt body 72 is comprised of a plurality of skirt strips respectively connected one another by zippers 720.

Figure 9:
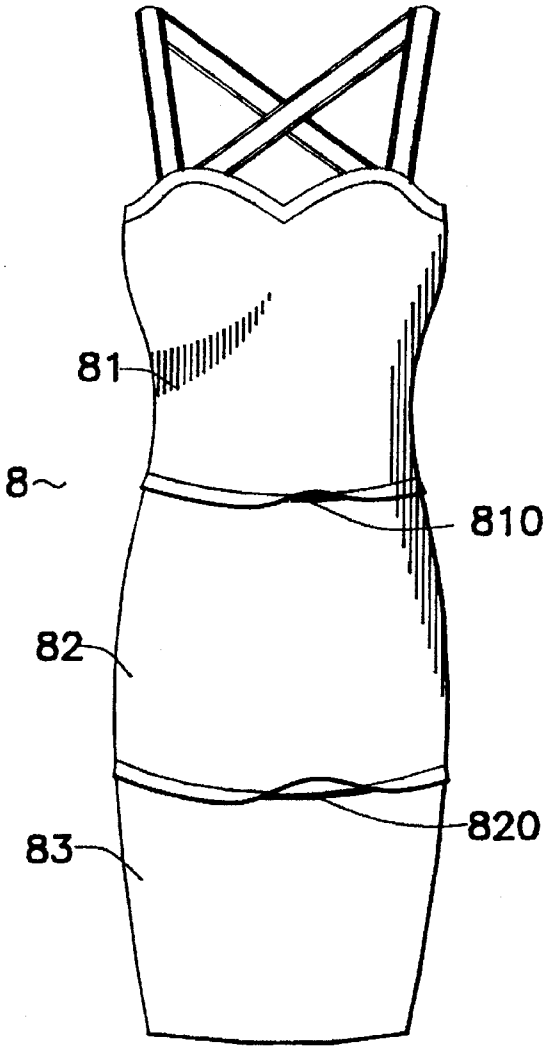
FIG. 9 shows a basic dress made according to the present invention.

Referring to FIG. 9, the basic dress 8 is comprised of a bodice 81, a hip panel 82 fastened to the bodice 81 by a zipper 810, and a hem 83 fastened to the hip panel 82 by a zipper 820.

It is to be understood that the drawings are designed for purposes of illustration only, and are not intended as a definition of the limits and scope of the invention disclosed. For example, hook and loop materials and/or snaps may be used instead of zippers.

I claim:

1. A separatable clothing comprising a base panel for covering at least a portion of a trunk of a human body and at least first and second auxiliary panels for respectively covering a single extremity of the human body, said base and auxiliary panels having zippers for fastening to one another, said first auxiliary panel fastening to said base panel and said second auxiliary panel fastening to said first auxiliary panel, wherein said separatable clothing is a shirt, said base panel is a shoulder part, said first and second panels are respectively upper and lower sleeves, said shirt further includes a front left panel, a from right panel, a rear left panel, and a rear right panel; said front left and right panels and said rear left and right panels having zippers for fastening; wherein said lower sleeves are fastened to said upper sleeves, said upper sleeves are fastened to said shoulder part, said from right and left panels and said rear left and fight panels are fastened to said shoulder part, said front left panel is fastened to said front fight panel, said front left panel is fastened to said rear left panel, and said rear fight panel is fastened to said rear left panel.

2. The separatable clothing of claim 1, wherein said upper sleeves each have three series of zippers and said lower sleeves are respectively fastened to one of said three series of zippers.

* * * * *